US010174922B2

(12) United States Patent
Wille

(10) Patent No.: US 10,174,922 B2
(45) Date of Patent: Jan. 8, 2019

(54) HANDHELD COMPACT FLASHLIGHT

(71) Applicant: Jesse Wille, Brooklyn Center, MN (US)

(72) Inventor: Jesse Wille, Brooklyn Center, MN (US)

( * ) Notice: Subject to any disclaimer, the term of this patent is extended or adjusted under 35 U.S.C. 154(b) by 0 days.

(21) Appl. No.: 15/479,797

(22) Filed: Apr. 5, 2017

(65) Prior Publication Data

US 2017/0299163 A1 Oct. 19, 2017

Related U.S. Application Data

(60) Provisional application No. 62/318,367, filed on Apr. 5, 2016.

(51) Int. Cl.

| | |
|---|---|
| ***F21L 4/00*** | (2006.01) |
| ***F21V 21/40*** | (2006.01) |
| ***F21V 3/00*** | (2015.01) |
| ***F21V 23/04*** | (2006.01) |
| ***F41G 1/35*** | (2006.01) |
| *F21Y 115/10* | (2016.01) |

(52) U.S. Cl.

CPC ..... *F21V 21/406* (2013.01); *F21L 4/005* (2013.01); *F21V 3/00* (2013.01); *F21V 23/0414* (2013.01); *F41G 1/35* (2013.01); *F21Y 2115/10* (2016.08)

(58) Field of Classification Search

CPC ..... F41G 1/35; F21L 4/005; F21V 23/0414

See application file for complete search history.

(56) References Cited

U.S. PATENT DOCUMENTS

| | | | | |
|---|---|---|---|---|
| 6,641,277 | B2 * | 11/2003 | Smith | F41G 1/36 362/110 |
| 8,985,804 | B2 * | 3/2015 | Frazier | F21L 4/00 362/110 |
| 2008/0049418 | A1 * | 2/2008 | Ross | F21L 4/04 362/109 |
| 2008/0074868 | A1 * | 3/2008 | Steele | F21L 4/025 362/184 |
| 2008/0198588 | A1 * | 8/2008 | O'Hern | F21L 4/00 362/183 |
| 2015/0219292 | A1 * | 8/2015 | Ross | F21V 21/0885 362/191 |

* cited by examiner

*Primary Examiner* — Evan Dzierzynski

(74) *Attorney, Agent, or Firm* — Westman, Champlin & Koehler, P.A; Amanda M. Prose

(57) ABSTRACT

A compact flashlight housing configured for hand held use concurrently with a hand-held weapon. The flashlight housing holds a light source and power source and is configured with a strap secured to an external surface of the housing opposite a light emitting surface. The strap is configured to be supported by one or more fingers of a user's hand and allows the flashlight to be held on a top side of a user's hand or outside of a user's fist while allowing the user to also securely grip a weapon with a two-hand grip.

15 Claims, 4 Drawing Sheets

HANDHELD COMPACT FLASHLIGHT

BACKGROUND OF THE INVENTION

Most Law Enforcement Officers carry a firearm. Officers generally must qualify several times per year to maintain proficiency with firearms in order to carry these weapons. Qualifications may include familiarity or proficiency in low light shooting since the majority of Officer involved shootings occur at dusk or after dark Many of the techniques for holding a flashlight while aiming and/or shooting semi-auto pistols require holding a tubular "tactical" flashlight in the Officer's "support hand" while attempting to also provide some stabilization to the firearm with their "gun hand." The techniques cause discomfort, provide insufficient support for the gun hand and present a potential for the Officer to drop the flashlight.

So called "tube flashlights" of the prior art have a handle or hand portion generally in the shape of a tube which may have ergonomic finger indentations for gripping, however these flashlights use incandescent bulbs and thus use the tube handle portion to house the required batteries such as D Cell of 9 Volt batteries, which are large in size.

SUMMARY

An aspect of the present disclosure relates to a hand held flashlight comprising a housing configured to hold a light source and a power source, wherein the light source emits light through a transparent front surface of the housing and a handle extending from a secure attachment to a rear surface of the housing wherein the handle comprises at least one loop configured to encircle a digit of a user such that flashlight is removably securable to the fingers of the user's hand and configured such that the light emitting surface is positioned outside of the user's hand when the user is concurrently gripping another object, such as a weapon. The light source may be an LED light source and the power source may be a rechargeable battery.

Yet another aspect of the present disclosure relates to the housing and handle which may also be comprised of a lightweight but durable material wherein more specifically the handle comprises a horizontal member branching into the loop and further comprising a support component wherein the loop is an upwardly directed loop and wherein the loop is further configured with an actuator for controlling the state of the light source. The loop is configured to encircle the digit on the user's support hand with the horizontal member passing between the digits to connection with the housing and the support component extends downwardly from the horizontal member.

Yet another aspect of the present disclosure relates to a method of using a hand held flashlight comprising providing a housing configured to hold a light source and a power source, wherein the light source emits light through a transparent front surface of the housing and having a handle extending from a secure attachment to a rear surface of the housing wherein the strap comprises at least one loop configured to encircle a digit of a user such that flashlight is removably securable to the fingers of the user's hand and configured such that the light emitting surface is positioned outside of the user's hand when the user is concurrently gripping another object. The flashlight is configured such that during use, the housing rests across the knuckles of a support hand of the user with the illumination source facing outward when the user makes a fist and the handle fits between an index and middle finger of the user to reduce the possibility of dropping the flashlight during use.

DETAILED DESCRIPTION

Figure 1A:
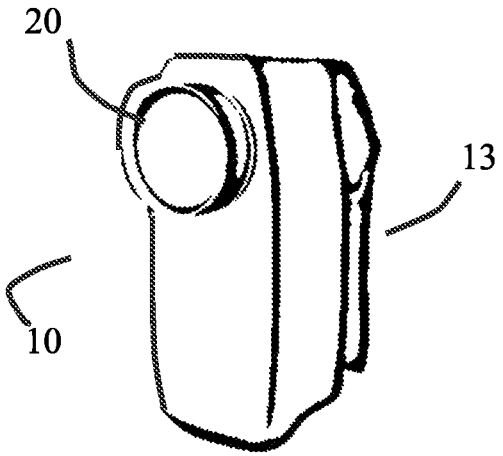
FIGS. 1A-1B are side perspective views of a hand held flashlight.
Figure 1B:
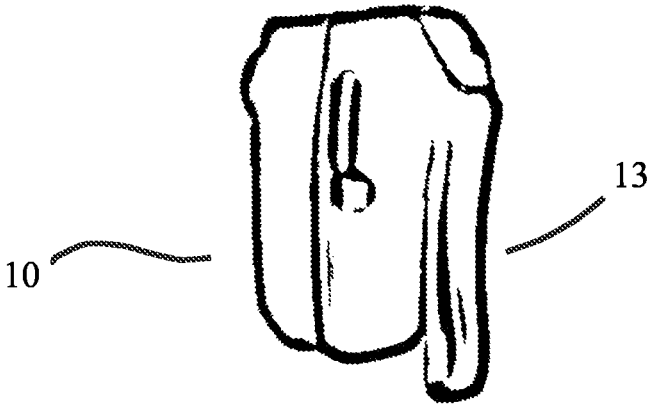
Figure 2A:
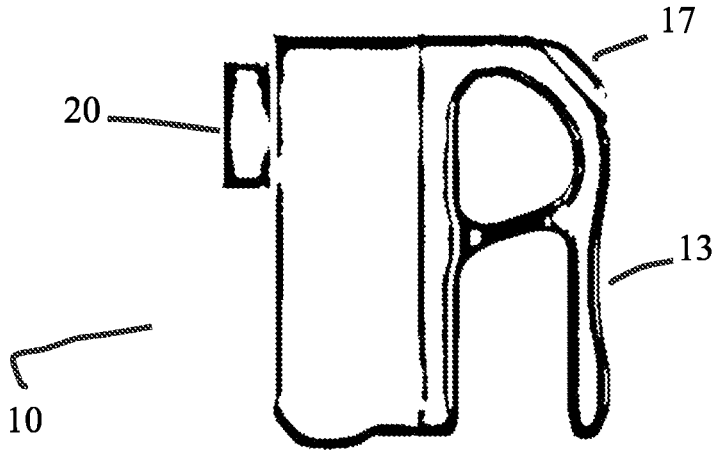
FIGS. 2A-2B are side views of a hand held flashlight for use with a weapon.
Figure 2B:
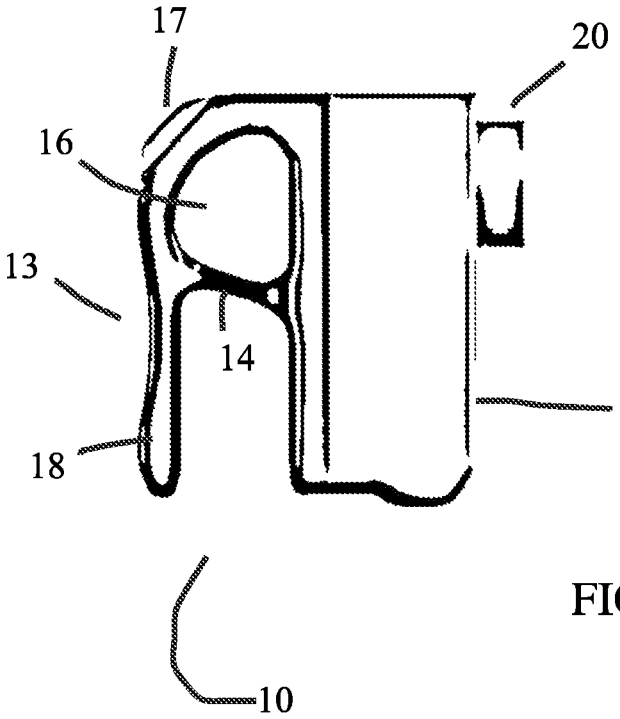
Figure 3A:
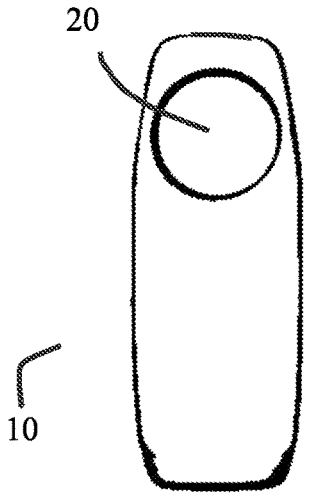
FIG. 3A is a front view of the hand held flashlight in a hand of a user.
Figure 3B:
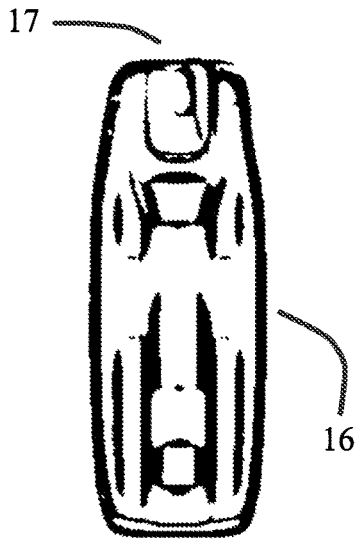
FIG. 3B is a back view of the hand held flashlight.
Figure 4:
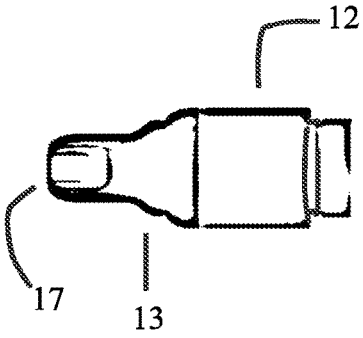
FIG. 4 is a top view of the hand held flashlight.

The flashlight 10 illustrated generally in FIGS. 1-4 is a compact, yet powerful flashlight configured to allow a user to utilize the flashlight 10 without compromising the use of the flashlight bearing hand for other functions, such as supporting the use of a firearm. The flashlight 10 is configured to provide sufficient illumination to an area while allowing the user to maintain a stable, unmodified, two handed grip on a weapon such as a pistol, revolver, electronic control device (e.g., tazer) or a long gun with a foregrip. The flashlight 10 is also fully functional in any capacity typically assumed by a standard tubular flashlight when no weapon or tool is being utilized concurrently.

In one embodiment, the flashlight 10 may feature a compact housing 12 that holds batteries, circuitry and an illumination or light source 20, such as a lamp or at least one LED. A rear of the housing 12 may have a strap or handle 13 attached thereto. The strap or handle 13 may be comprised of molded plastic or a molded metal material and may further optionally have a coating or a layer of a material flexible or softer material on top of the molded handle to provide a softer or more comfortable handle for positioning on the hand and around the fingers.

Alternatively, a portion of the handle or the handle itself may comprise only the exposed molded material. The handle 13 may comprise a horizontal member 14 that branches into an upward loop 16 and downward support 18. The upward loop 16 may also feature a switch 22 that controls the light source 20. The loop 16 is configured to encircle a digit on the users support hand with the horizontal member 14 passing between the digits to the housing 12. The housing 12 can be held by this grip in a substantially vertical descent across the users knuckles with the light source 20 positioned on the side of the housing 12 opposite the knuckles, thus projecting the light outwardly, in a forward direction, or otherwise in front of where the user moves their hands. The components of the housing and the strap or handle may be comprised of a lightweight metal, such as aluminum or an alloy, or a plastic or plastic based material. The handle and housing compositions may be the same material or different materials from one another and examples may further include other materials that are lightweight and sturdy and resistant to water or moisture. Plastic or other lightweight durable materials may be used as they provide enough rigidity to the handle such that the light can be supported in an upright and outward light emitting position on a user's hand wherein the user's hand may be various sizes.

The loop 16 may be a top finger loop 16 which incorporates the button switch 17 for controlling or activating the light source, or otherwise configured to turns the light on and off when pressed or switched. The button may rest where the user's thumb naturally rests when making a fist with the hand. In this way, the handle is optimally situated for the user's thumb to activate the light when it is a stand-alone flashlight. When holding, aiming or shooting the weapon with the flashlight 10 on the support hand, the support hand is able to wrap around the bottom three knuckles of the gun hand on the gun grip. The slim handle allows the user to maintain a stable grip while activating the light by squeezing their support hand against their gun hand knuckles. This allows the user to maintain an exact two handed grip and proper shooting stance while holding the firearm and the flashlight.

The flashlight may incorporate a light source 20 that comprises LED technology and the batteries may then correspondingly be of a reduced or compact size. The battery may also be a rechargeable battery where the housing is configured with a connection for charging the battery where the connection is a standard USB port or micro-USB port compatible port, for example, the flashlight 10 and battery may be configured to recharging using one of many standard phone, device or tablet chargers.

The flashlight 10 may also be configured for use in multiple settings, for example, the flashlight 10 may have a plurality of operating modes including a high beam mode; wide beam mode; and/or red mode which does not negatively affect vision at night or in low light.

Figure 5:
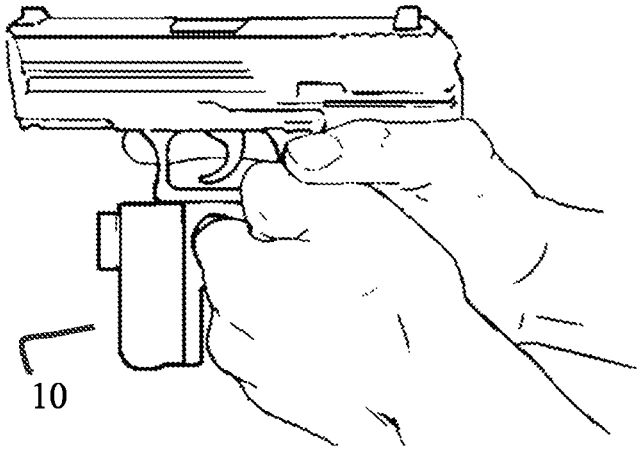
FIG. 5 is a side view of the hand held flashlight in use concurrently with a weapon.
Figure 6:
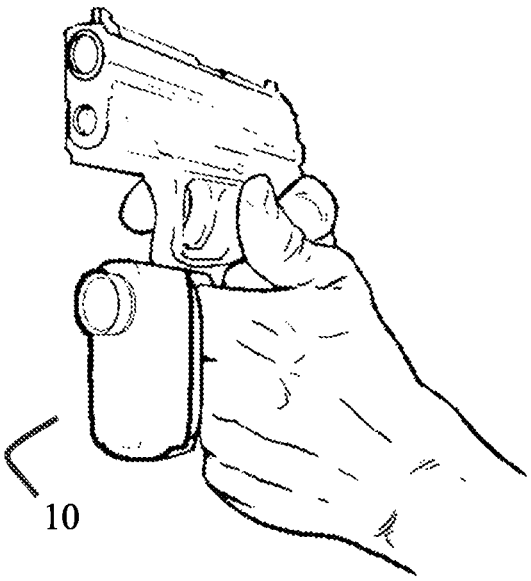
FIG. 6 is a perspective view of the hand held flashlight in use concurrently with a weapon.

As illustrated in FIGS. 5 and 6, in use, the housing 12 is configured to rest across the knuckles of the support hand of the user with the illumination source, or light, facing outward when the user makes a fist and holds their arm directly out in front of them and having their thumbs in an "up" orientation. The housing 12 comprises the slim handle 14 that fits comfortably between the user's index and middle finger and comes to an intersection, or "T" in order to provide support for the light by encircling the user's pointer finger. The design of the flashlight 10 substantially reduces or eliminates the possibility of dropping the light during use, with or without a firearm.

Although the present disclosure has been described with reference to preferred embodiments, workers skilled in the art will recognize that changes may be made in form and detail without departing from the spirit and scope of the disclosure.

The invention claimed is:

1. A hand held flashlight comprising:

a housing configured to hold a light source and a power source, wherein the light source emits light through a transparent front surface of the housing;

a handle extending from a secure attachment with a rear surface of the housing wherein the handle comprises at least one loop positioned behind the light source and configured to encircle a digit of a user such that flashlight is removably securable to the fingers of the user's hand and configured such that the light emitting surface is positioned outside of the user's hand when the user is concurrently gripping another object; and wherein the handle further comprises a support member extending away from secure attachment with the rear surface of the housing and the support member branching at a distal end in a first direction into the loop and in a second direction into a support surface wherein the first and second direction are opposing directions.

2. The flashlight of claim 1 wherein the light source is an LED light source.

3. The flashlight of claim 1 wherein the light source is a rechargeable battery.

4. The flashlight of claim 1 wherein the housing and handle are comprised of a plastic material.

5. The flashlight of claim 1, wherein the loop is an upwardly directed loop and wherein the loop is further configured with an actuator for controlling a state of the light source.

6. The flashlight of claim 1, wherein the loop is configured to encircle the digit on the users support hand with the horizontal member passing between the digits to connection with the housing and the support component extends downwardly from the horizontal member.

7. The flashlight of claim 1, wherein the light source is configured for settings including high beam mode, wide beam mode, red beam mode and a combination thereof.

8. A method of using a hand held flashlight comprising:

providing a housing configured to hold a light source and a power source, wherein the light source emits light through a transparent front surface of the housing and having a handle extending from a secure attachment to a rear surface of the housing wherein the handle comprises at least one loop configured to encircle a digit of a user such that flashlight is removably securable to the fingers of the user's hand and configured such that the light emitting surface is positioned outside of the user's hand when the user is concurrently gripping another object; and wherein the handle further comprises a support member extending away from secure attachment with the rear surface of the housing and the support member branching at a distal end in a first direction into the loop and in a second direction into a support surface wherein the first and second direction are opposing directions.

9. The method of claim 8, wherein using the flashlight further comprises:

resting the housing across the knuckles of a support hand of the user with the illumination source facing outward when the user makes a fist; and fitting the handle between an index and middle finger of the user to reduce the possibility of dropping the flashlight during use.

10. The method of claim 8 wherein the light source is an LED light source.

11. The method of claim 8 wherein the light source is a rechargeable battery.

12. The method of claim 8 wherein the housing and handle are comprised of a plastic material.

13. The method of claim 8, wherein the loop is an upwardly directed loop and wherein the loop is further configured with an actuator for controlling the state of the light source.

14. The method of claim 8, wherein the loop is configured to encircle the digit on the users support hand with the support member passing between the digits to connection with the housing and the support surface extends downwardly from the support member.

15. The method of claim 8 and further comprising changing the light source between settings wherein the settings including high beam mode, wide beam mode, red beam mode and a combination thereof.

* * * * *